US005374872A

United States Patent [19]

Balaschak et al.

[11] Patent Number: 5,374,872

[45] Date of Patent: Dec. 20, 1994

[54] MEANS FOR SUPPORTING AND SEALING THE LEAD STRUCTURE OF A LAMP AND METHOD FOR MAKING SUCH LAMP

[75] Inventors: Edward J. Balaschak, Cleveland; Curtis E. Scott, Mentor; George E. Sakoske, Chagrin Falls, all of Ohio

[73] Assignee: General Electric Company, Schenectady, N.Y.

[21] Appl. No.: 976,061

[22] Filed: Nov. 13, 1992

[51] Int. Cl.[5] ..... H01J 17/18; H01J 61/36

[52] U.S. Cl. ..... 313/623; 313/625; 313/626; 313/332; 313/333; 313/578

[58] Field of Search ..... 313/623, 625, 626, 634, 313/252, 266, 284, 287, 332, 333, 578

[56] References Cited

U.S. PATENT DOCUMENTS

| | | | |
|---|---|---|---|
| 2,245,394 | 1/1941 | Francis et al. | 176/126 |
| 2,316,999 | 7/1941 | Spencer | 250/27.5 |
| 4,202,999 | 5/1980 | Holle et al. | 174/50.61 |
| 4,475,061 | 10/1984 | van de Weijer et al. | 313/623 |
| 4,537,323 | 8/1985 | Ditchek et al. | 313/625 X |
| 4,942,331 | 7/1990 | Bergman et al. | 313/623 X |
| 5,077,505 | 12/1991 | Ekkelboom et al. | 313/623 |

FOREIGN PATENT DOCUMENTS 2072937 3/1980 United Kingdom .

*Primary Examiner*—Donald J. Yusko
*Assistant Examiner*—Ashok Patel
*Attorney, Agent, or Firm*—Stanley C. Corwin; Edward M. Corcoran

[57] ABSTRACT

This lamp comprises (1) an envelope of vitreous light-transmitting material enclosing an internal space where light is generated and (ii) conductive lead structure projecting into said internal space. Surrounding and sealed to said lead structure is a body of vitreous material formed of particles of vitreous material pressed together and sintered. This body extends through an opening in the envelope that communicates with said internal space. A hermetic seal is provided between said envelope and said body in the interface region between said envelope and said body.

18 Claims, 6 Drawing Sheets

Fig. 3
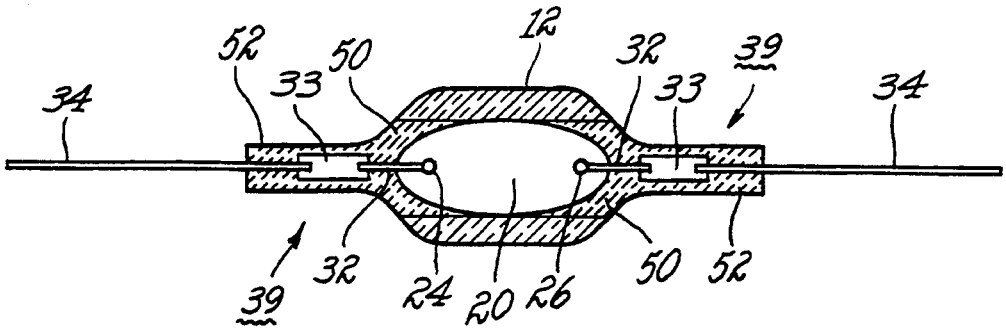
Fig. 4
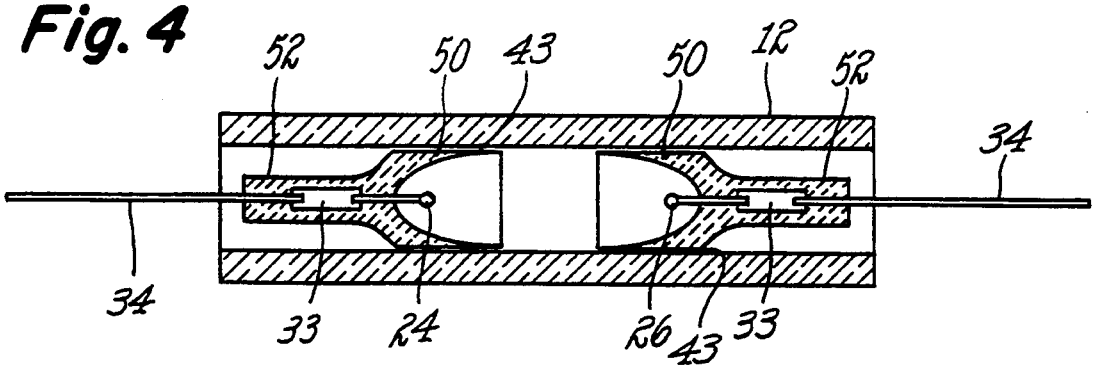
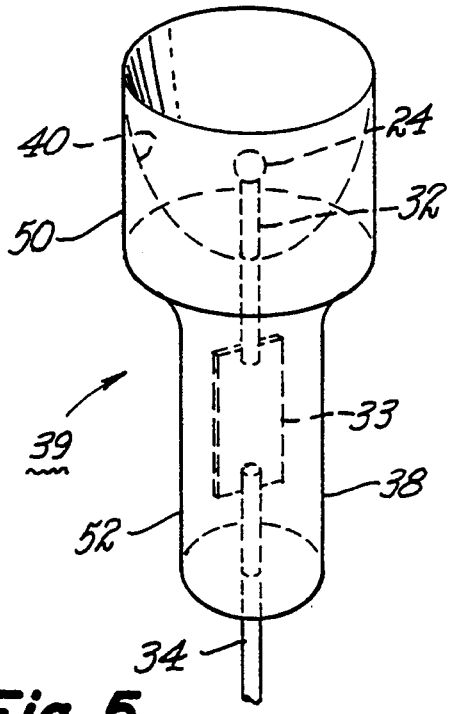
Fig. 5
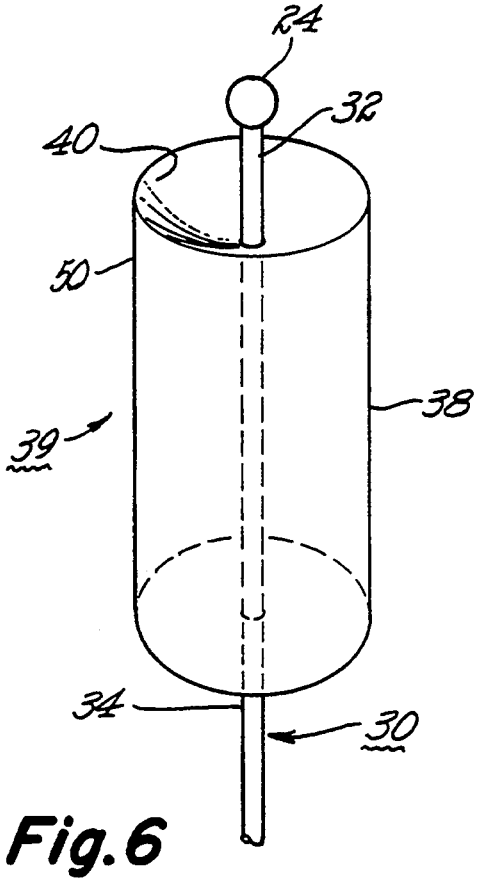
Fig. 6

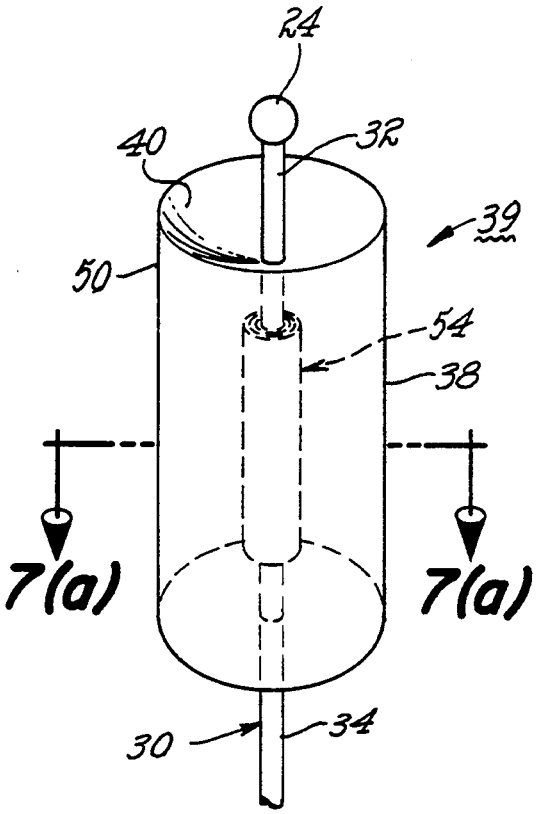
Fig. 7
Fig. 7(a)
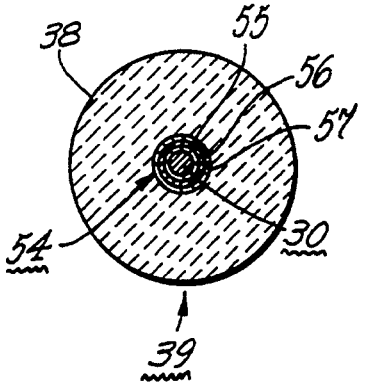
Fig. 8
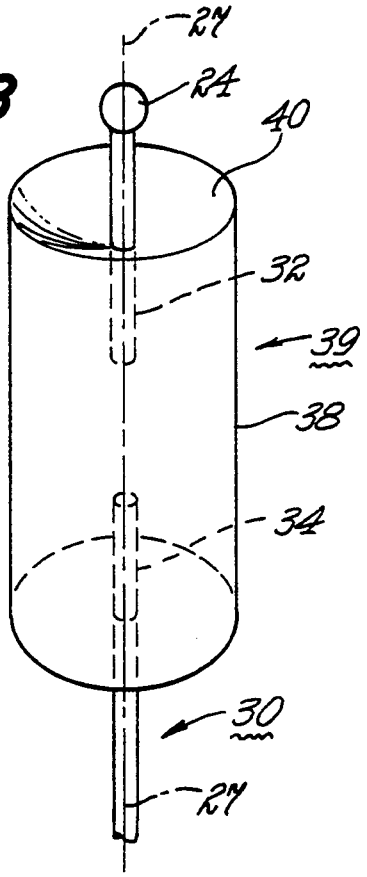
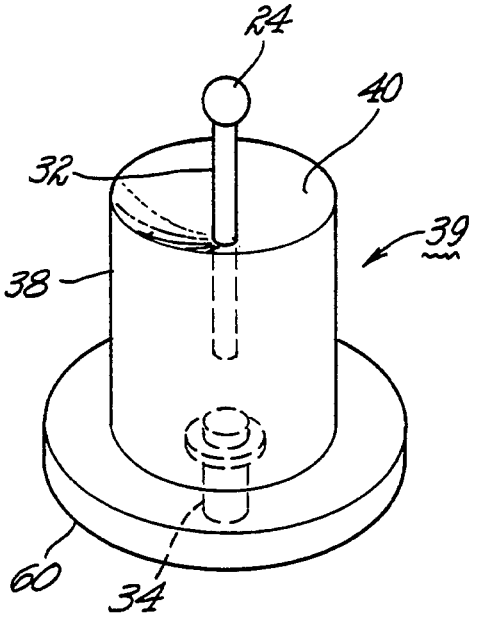
Fig. 9

Fig.10
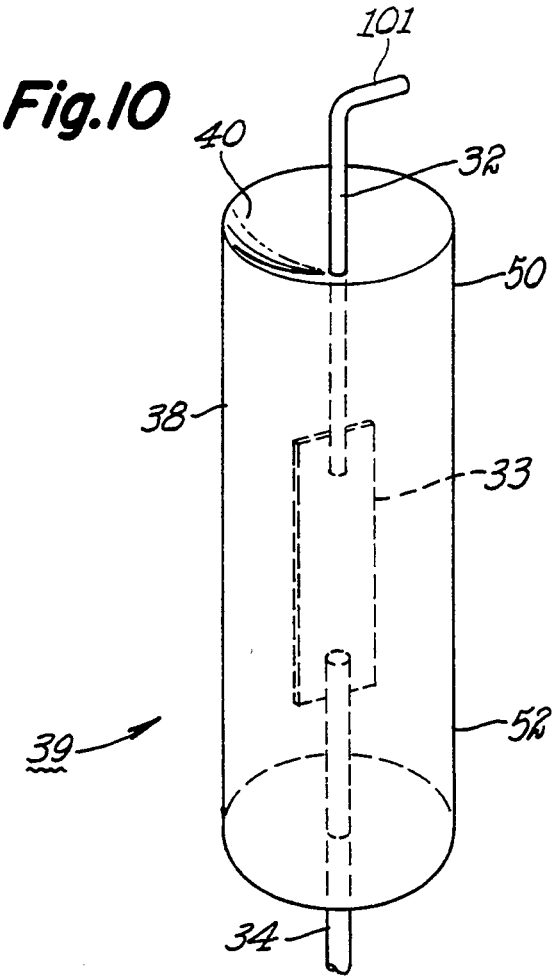
Fig.11
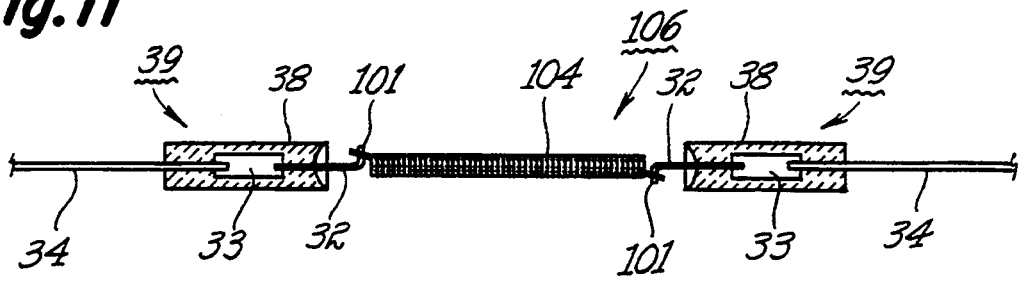
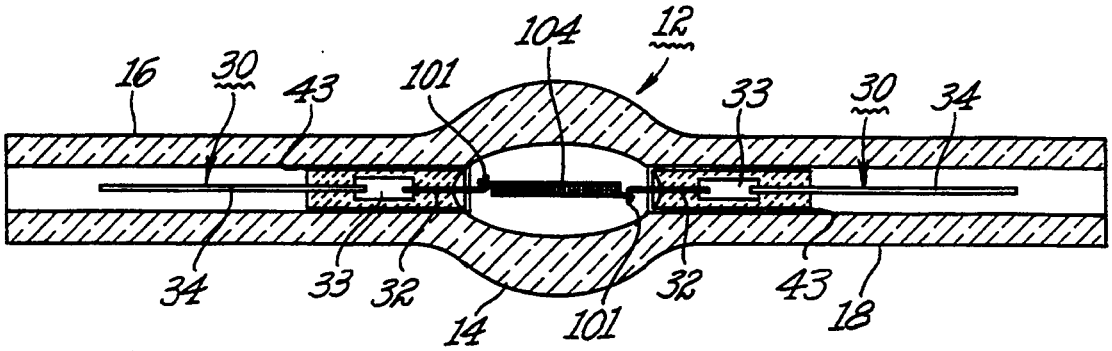
Fig.12

MEANS FOR SUPPORTING AND SEALING THE LEAD STRUCTURE OF A LAMP AND METHOD FOR MAKING SUCH LAMP

TECHNICAL FIELD

This invention relates to a lamp that comprises (i) an envelope of vitreous light-transmitting material enclosing an internal space where light is generated, (ii) conductive metallic lead structure projecting into said internal space, and (iii) means for supporting said lead structure on said envelope and forming a seal between said lead structure and said envelope. The invention also relates to a method of making such a lamp.

BACKGROUND

In certain lamps of the above type, it is important that the light-generating means be precisely located in a predetermined position within the envelope of the lamp. For example, in a metal-halide discharge lamp, light is generated by an arc developed between spaced electrode tips, and these tips must be precisely located with respect to each other and the surrounding envelope in order to achieve proper envelope or arc-tube temperature distribution and desired optical properties, life and lumens output. The electrode tips are located by supporting them on leads which extend through openings in the envelope, and seals are formed between the envelope and the leads in order to support the leads on the envelope and to prevent any leakage in this region. The seals can be either of the pinch-seal type or the shrink-seal type.

One obstacle to achieving precise positioning cf the electrode tips is the difficulty of making the seals without introducing such distortion of the sealing regions of the envelope that displaces the leads and electrode tips from the precise positions desired. We are concerned with providing a seal and support structure for the leads that lends itself to achieving precise positioning of the light-generating means, for example, the electrode tips in the case of a discharge lamp.

In addition to the need for precise positioning of the electrode tips, there is a need to hold the inner geometry of the light-transmitting envelope to close design tolerances in order to meet certain color separation, life, and quality requirements. The above-described difficulty of making the seals about the leads without introducing distortion of the sealing regions of the envelope is an obstacle to achieving the precise inner geometry desired for the envelope. We are concerned with providing seal and support structure for the leads that facilitates achieving the precise desired inner geometry of the envelope.

We are also concerned with providing a method of constructing the seal and support structure that enables us to achieve precise positioning of the light-generating means and precise control of the inner geometry of the envelope.

Our invention is also applicable to filament type lamps, e.g., the double-ended halogen lamp containing a tungsten filament and one or more halogens within the filament chamber, with the surface of the filament chamber having a coating or filter thereon which transmits visible light radiation but which reflects infrared radiation back to the filament. Such lamps require precise radial alignment of the filament along the optical axis of the filament chamber in order to achieve maximum conversion of the infrared radiation reflected by the coating back to the filament to visible light radiation which is transmitted by the coating. A lamp of this type is disclosed and claimed in U.S. Pat. No. 4,942,331—Bergman et. al., assigned to the assignee of the present invention.

SUMMARY

In carrying out our invention in form, we provide a lamp comprising (a) a tubular envelope of vitreous light-transmitting material enclosing an internal space where light is generated and (b) conductive lead structure projecting into said internal space. Surrounding and sealed to said lead structure is a body of vitreous material formed of particles of vitreous material consolidated together and sintered. This body extends through an opening in the envelope that communicates with said internal space. A hermetic seal is provided between said envelope and said body in the interface region between said envelope and said body.

In a double-ended discharge-type of lamp embodying the invention, the conductive lead structure supports at its inner end one of the electrode tips of the discharge lamp. In a double-ended filament-type lamp embodying the invention, the conductive lead structure is provided with an inner end that is suitably attached to one end of the filament of the lamp.

In one specific form of the invention, a metal having generally the same coefficient of thermal expansion as the metal of said conductive lead structure is incorporated in said body of vitreous material and is distributed within the body. In one embodiment of this form, the concentration of said metal is higher in the region of the conductive lead structure than in said interface region.

Another feature of our lamp is the sintered body has an inner end facing said internal space and having a concave configuration that merges smoothly with the surrounding portion of the envelope bordering said internal space.

In carrying out the method of our invention in one form, we construct the lead structure and the vitreous body as a subassembly, pressing the particles of vitreous material about the lead structure to form a compact surrounding the lead structure and then sintering this compact. The resulting subassembly is then inserted into said opening in the envelope, following which the hermetic seal is made between the envelope and the body.

In carrying out our method in one specific form, we incorporate a conductive species within the compact cf the immediately-preceding paragraph. This is done either by mixing metal particles with the vitreous particles prior to forming the compact or by infiltrating the compact with molten metal or with a metallic solution. The conductive species is utilized for producing a match in coefficients of thermal expansion of the conductive lead structure and the region of the vitreous body immediately adjacent the conductive lead structure.

In carrying out the method of our invention in another form, we form a body having a central passage therein by pressing vitreous particles into a compact of this configuration. We then infiltrate this compact with conductive species and then insert the lead structure in the central passage. Following this, we sinter this assembly at elevated temperature in an inert atmosphere and then allow it to cool, causing the infiltrated vitreous material to shrink about the lead structure and form a seal therewith.

BRIEF DESCRIPTION OF FIGURES

For a better understanding of the invention, reference may be had to following detailed description taken in connection with the accompanying drawings, wherein:

FIG. 3 is a cross-sectional view through a discharge lamp embodying a modified form of the invention.

FIG. 4 is a cross-sectional view showing one step used in a method for making the lamp of FIG. 3.

FIG. 5 is a perspective view of a subassembly constituting a part of the lamp of FIGS. 3 and 4.

FIG. 6 is a perspective view of a modified form of a subassembly usable in the lamp of FIG. 1 in place of the subassembly of FIG. 2.

FIG. 7 is a perspective view of another modified form of a subassembly usable in the lamp of FIG. 1 in place of the subassembly of FIG. 1.

FIG. *7a* is a sectional view along the line *7a—7a* of FIG. 7.

Figure 1:
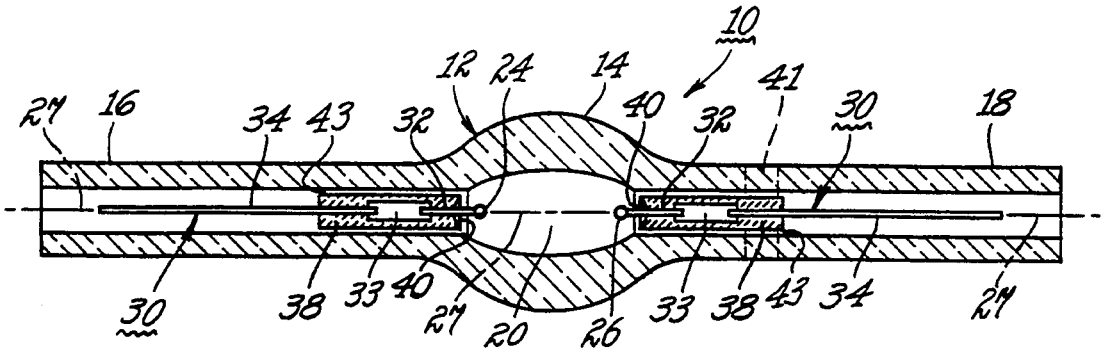
FIG. 1 is a cross-sectional view through a discharge lamp embodying one form of the invention.
Figure 2:
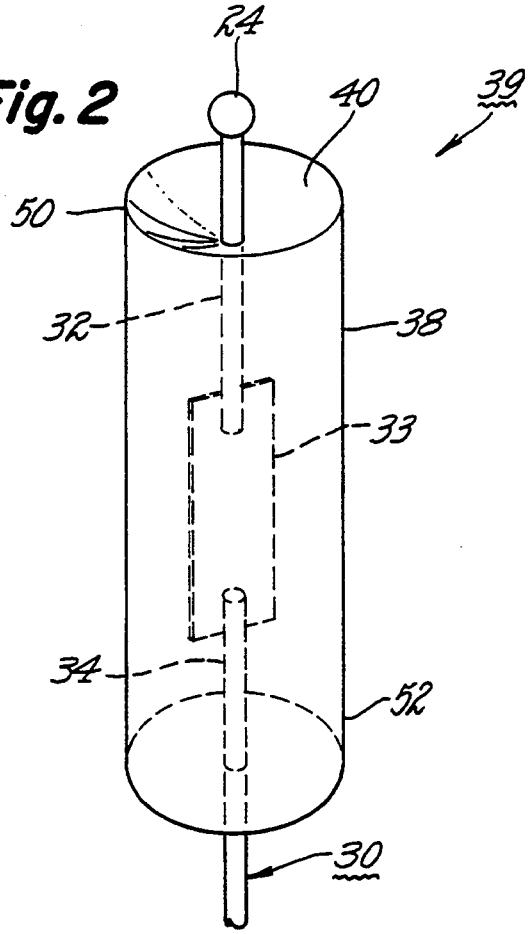
FIG. 2 is a perspective view of a lead-supporting subassembly which constitutes a part of the lamp of FIG. 1.

FIG. 8 is a perspective view of another modified form of subassembly usable in the lamp of FIG. 1 in place of the subassembly of FIG. 2.

FIG. 9 is a perspective view of still another modified form of a subassembly usable in a lamp similar to that of FIG. 1 in place of the subassembly of FIG. 2.

FIG. 10 is a perspective view of still another modified form of lead-supporting subassembly. This subassembly is for use in a filament-type, or incandescent, lamp.

FIG. 11 is a side elevational view of a filament assembly comprising two of the subassemblies of FIG. 10 and a filament connected between the subassemblies.

FIG. 12 is a cross-sectional view of double-ended incandescent lamp including the filament assembly of FIG. 11.

Figure 13:
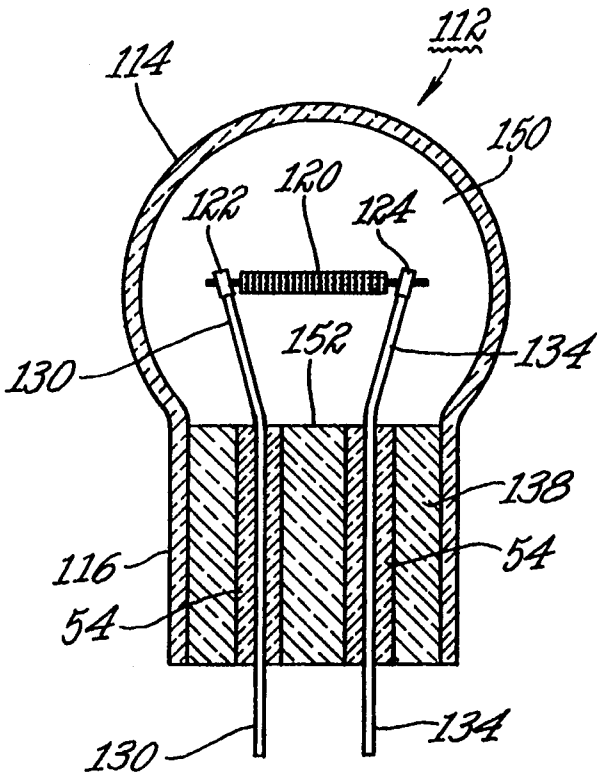

FIG. 13 is a cross-sectional view of a single-ended incandescent lamp embodying another modified form of our invention. The lamp is shown at an intermediate stage of its assembly.

Figure 14:
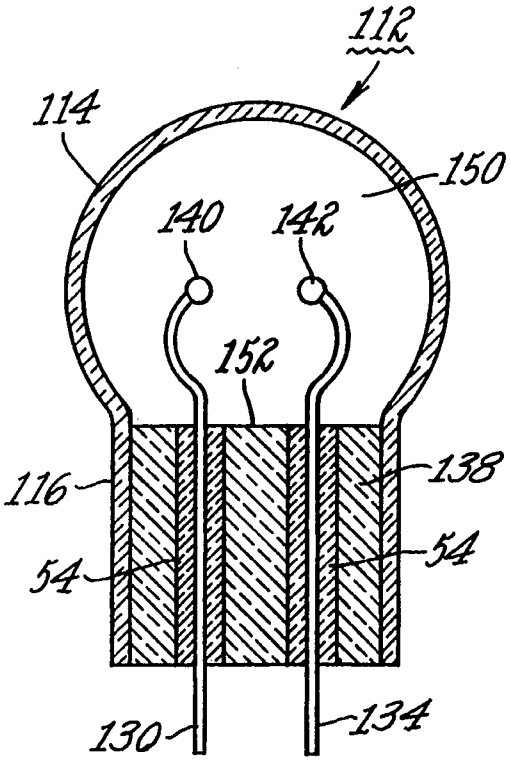

FIG. 14 is a cross-sectional view, taken during assembly, of a single-ended discharge lamp embodying still another modified form of our invention.

Figure 15:
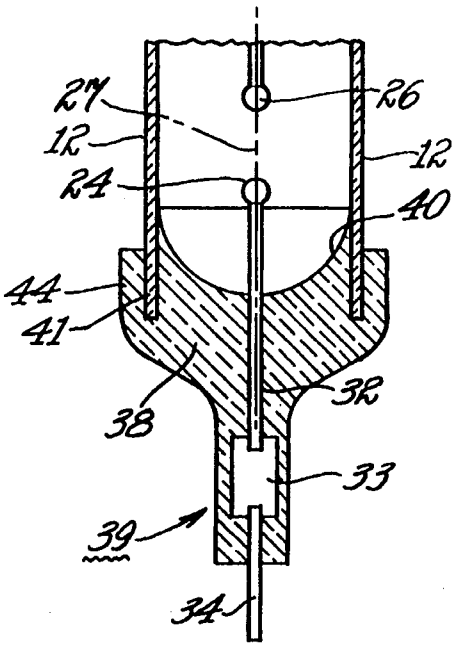

FIG. 15 is a cross-sectional view, taken during assembly, of a portion of another lamp embodying a modified form of the invention.

Figure 16:
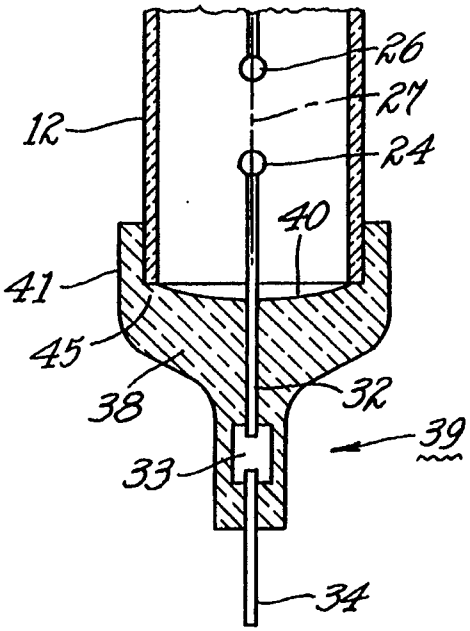

FIG. 16 is a cross-sectional view, taken during assembly of a portion of still another lamp embodying a modified form of the invention.

Figure 17:
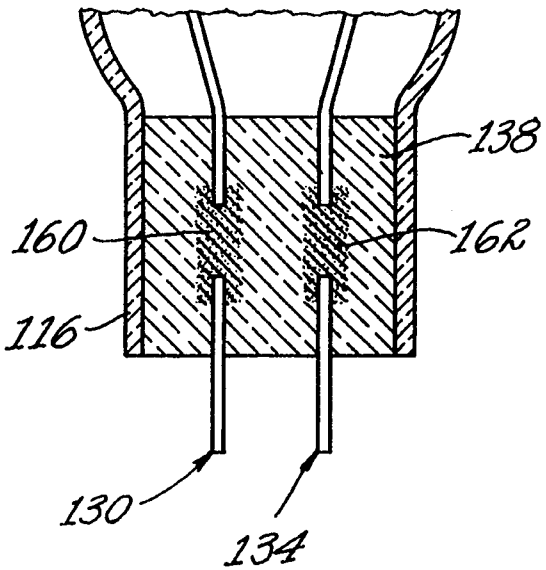

FIG. 17 shows a modified form of the lamp of FIG. 13.

DETAILED DESCRIPTION OF EMBODIMENTS

Referring now to FIG. 1, the lamp 10 depicted therein comprises a tubular envelope 12 of vitreous light-transmitting material, such as fused quartz. Envelope 12 comprises a bulbous central portion 14 and two tubular legs 16 and 18 projecting axially in opposite directions from the bulbous central portion. Within the bulbous central portion 14 there is an internal space 20 where light is generated during lamp operation by an electric arc developed between a pair of spaced-apart electrode tips 24 and 26. The lamp has a central longitudinal axis 27 on which are located the electrode tips 24 and 26 and the central axes of the legs 16 and 18 and the bulbous portion 14.

Each of the electrode tips 24 and 26 is supported on lead structure 30 that extends along central axis 27 through one of the tubular legs 16 and 18 and projects into the internal space 20. In the form of the invention shown in FIGS. 1 and 2, the lead structure 30 comprises an inner rod 32, preferably of tungsten or molybdenum or their alloys, a foil element 33 preferably of molybdenum, and an outer rod 34, preferably of tungsten or molybdenum or their alloys. The adjacent ends of the inner and outer rods are joined to the foil element in a conventional manner.

For supporting each of the lead structures 30 within one of the legs of the envelope 12, we provide a body 38 of sintered vitreous material having a substantially cylindrical exterior that fits (in a manner soon to be described) within the substantially cylindrical bore of the associated leg. FIG. 2 illustrates this body 38 and the lead structure 30 on a larger scale and as a subassembly 39 separate from the lamp envelope 12. This subassembly is fabricated separately from the lamp envelope and is thereafter incorporated into the lamp envelope by inserting it through the outer end of the associated leg 16 or 18. In one embodiment, before sealing of the leg 16 to the body 38 a relatively loose fit providing a narrow passage 43 is present between these parts.

In one form of the invention, the body 38 is formed about the lead structure 30, first, by placing the lead structure in a mold that has a substantially cylindrical cavity surrounding the lead structure and then by filling the cavity with particles of vitreous material that are thinly coated with a suitable binder. (Alternatively, dry particles of binder could be mixed with the vitreous particles.) Then the particle fill is compacted within the mold, either by using a dry press or by using isostatic pressing apparatus. Preferably, the mold has a convex end wall against which the fill is pressed during compacting, thereby imparting to the end 40 of body 38 a configuration of concave form, as shown in FIGS. 1 and 2. During the above-described compacting operation, the rods 32 and 34 are held in the fixed positions shown in FIG. 2 by suitable fixtures (not shown) which prevent the rods from shifting during the compacting operation.

The subassembly 39 is then removed from the mold and placed in a furnace containing an inert atmosphere, where it is heated to an appropriate high temperature and maintained at that temperature long enough to effect sintering together of the vitreous particles. This sintering action converts the body 38 into a hard mass that is hermetic and contains no interconnecting porosity, i.e., contains no pores therethrough that would allow leakage through the body when present in the lamp. After the sintering operation, a good hermetic seal is present between the foil element 33 and the surrounding sintered vitreous body 38.

A large number of subassemblies corresponding to the subassembly 39 are fabricated at substantially the same time and, thus, are available for assembly in lamps corresponding to that of FIG. 1. One of these subassemblies 39 is inserted into the hollow leg 16 through its outer end until the subassembly reaches its position of FIG. 1, and another is inserted into hollow leg 18 through its outer until this subassembly reaches its position of FIG. 1. Then a hermetic seal is made between one cf the legs (e.g. 18) and the outer periphery of the associated body 38, preferably by heating a localized annular region 41 of the leg to its softening point and then collapsing this localized region about the body 38 to effect a hermetic seal between the leg and the subassembly. This heating is done in a conventional manner , for example, with a ring-type burner (not shown) surrounding the leg 18, which also heats the body 38 to facilitate joining of the two parts 18 and 38.

After the first seal is made as above-described, the internal space 20 is evacuated through the narrow passage 43 between the other body 38 and the bore of the surrounding leg 16, following which a suitable gaseous fill is introduced through this passage, following which a seal is made in a conventional manner between the leg 16 and the body 38. The same technique as used for making the first seal can be used for making this second seal.

To facilitate evacuation and subsequent filling of the internal space 20, body 38 may be provided with one or more non-circular or flattened regions (not shown) along its full length on its external surface to provide between this external surface and the bore of the leg 16 one or more passages through which gases may be caused to flow during such evacuation and filling. Alternatively, a tubulation (not shown) extending through the bulbous central portion can be provided to afford a passage for such evacuation and filling, which tubulation would be sealed off when filling has been completed.

As noted above, the body 38 is made of a vitreous material, and this vitreous material is selected so as to have substantially the same coefficient of thermal expansion as the material of surrounding leg (16 or 18) of the envelope 12. For example, the body 38 can be formed from fused silica powder and the leg 16 or 18 of fused quartz. These materials have substantially the same coefficient of thermal expansion. These matching coefficients enable a high quality seal to be made with a near minimum in uneven distortion of the two parts. Because the seal-making operation that is used for forming the seal between the leg 16 or 18 and the sintered body 38 causes little uneven distortion of the body 38, the electrode tips remain in their predetermined desired positions within the internal space 20 during and following the seal-making operation. Thus, positioning of the electrode tips with respect to each other and to the surrounding envelope can be precisely controlled.

As pointed out hereinabove, it is important that the inner geometry of the enclosing structure surrounding the light-generating space 20 be held to close design tolerances in order to meet certain color separation, life, and quality requirements. Our design is especially effective in this respect in that the configuration of this structure is substantially unaffected by the sealing operations described hereinabove that are used for making seals between the legs 16 and 18 and the vitreous bodies 38. In prior lamps, the regions of the enclosing structure behind the electrode tips are the regions typically distorted by the envelope-to-lead sealing operation. But our sintered bodies 38 maintain their original configuration in these regions, which are located at their inner surfaces 40, and thus are not distorted in these regions by the sealing operation. The concave configuration of the surface 40 shown in FIG. 2 is the desired shape for the envelope in this region, and this concave shape is maintained in the finished lamp. The front regions 50 of bodies 38, with their concave front surfaces, are sometimes preferred to herein as bowls. The back regions are designated 52.

The compacting and sintering operations used for making the body 38 are especially advantageous for this application because they lend themselves to the production of a precisely-dimensioned part that can be held to close design tolerances.

It should be noted that the lamp is a modular assembly in which identical subassemblies (39) are inserted into opposite ends of the tubular envelope 12. The subassemblies and the tubular envelope are sturdy components which can readily be handled during manufacture of the lamp by high-speed handling equipment. These features contribute to a reduced part count and simplify the manufacturing equipment and processes.

FIGS. 3–5 show a modified embodiment of the invention. The completed lamp is shown in FIG. 3; one step in the manufacturing process is shown in FIG. 4; and one of the inserts, or subassembly 39, is shown in FIG. 5 in an enlarged perspective view. The parts of this embodiment that correspond to similar parts in the FIG. 1 embodiment have been assigned corresponding reference numerals. In the embodiment of FIGS. 3–5, each of subassemblies differs from subassembly 39 of FIG. 2 primarily in the shape of the front portion 50 (or bowl) of body 38. In FIG. 5, this front portion (or bowl) 50 of body 38 is enlarged in diameter with respect to the back portion 52 and forms a part of the bulbous portion of the envelope 12 in the finished lamp. Also this front portion 50 has a much more pronounced concave shape for its front surface 40 than is the case with the FIGS. 1–2 embodiment. In the FIGS. 3–5 embodiment, the front surface 40 is paraboloidal in shape and surrounds the associated electrode tip (24 or 26). The vitreous body 38 of FIGS. 3–5 is made of sintered together vitreous particles of the same composition as the particles of FIGS. 1–2, processed into the finished body (38) in the same manner as described in connection with FIGS. 1–2.

The lamp of FIG. 3 is assembled by inserting two of the subassemblies 39 of FIG. 5 into a quartz tube 12, as shown in FIG. 4, following which the quartz tube is sealed to the outer periphery of one of the bowls 50, following which the internal space 20 is evacuated through the narrow passage 43 surrounding the other bowl 50. Then a suitable fill is introduced into internal space 20 through passage 43, following which a seal is made between the outer periphery of the second bowl 50 and the bore of tube 12. Then the ends of the quartz tube 12 are removed to impart the desired finished shape to the envelope.

The sealing operations employed for sealing the bowls 50 of FIG. 4 to the outer tube 12 do not appreciably distort the bowls 50 and, thus, do not detrimentally affect the alignment of the electrode tips 24 and 26 or the precise desired internal geometry of the structure surrounding the light-generating space 20.

An important advantage of the lamp of FIGS. 3–5 is that the envelope portion 12 can be of a simple tubular configuration of uniform diameter. No expensive and time-consuming shaping of this member into a bulbous form, such as shown at 14 in FIG. 1, is required.

FIG. 6 illustrates another embodiment of the invention similar to that of FIGS. 1 and 2, except employing a graded type seal instead of the foil seal of FIG. 1 and 2. This sintered body 38 of FIG. 6 is made of a combination of sintered vitreous particles and conductive metal. In one form, the body 38 is made from a mixture of vitreous particles and molybdenum or tungsten particles. This mixture is compacted in a mold to full density and then sintered at high temperature. The concentration of the metal particles is made much higher adjacent the lead structure 30 than adjacent the outer periphery of the body, preferably decreasing gradually from the inner periphery of the body 38 to near zero at the outer periphery. In the final sintered body the metal is distributed in essentially the same manner.

The higher metal concentration adjacent the lead structure 30 enables a closer match in coefficients of thermal expansion to be obtained between the inner peripheral portion of body 38 and lead structure 30, thus enabling a more reliable seal to be obtained between these parts. Adjacent the outer periphery of the body 38 the substantial absence of metal enables a closer match in the coefficients of thermal expansion of the outer peripheral portion of bowl 50 and the quartz tube 12, thus enabling a reliable seal to be obtained in this region.

This subassembly of FIG. 6 is inserted into one leg of a quartz or glass envelope in the same manner as the subassembly 39 or FIG. 2 is inserted into the leg 16 of envelope 12 of FIG. 1, following which a seal is made about the outer periphery of body 38 in substantially the same manner as described in connection with FIGS. 1 and 2. The front portion, or bowl 50, of FIG. 6 has a concave front face 40 that remains substantially unchanged in shape and location despite the sealing operation.

Another way of making the body 38 of FIG. 6 is, first, to provide a porous matrix of vitreous material, e.g., Vycor sintered quartz, having substantially the shape and size of body 38. Then, the porous matrix is infiltrated with a metallic salt solution that is subsequently reduced to a conductive metal by suitable processing. The matrix can be produced without the lead 30 present but with a central passageway for subsequently receiving the lead. Infiltration of the matrix is effected by supplying the metallic salt solution through this central passages before the lead 30 is introduced. Thereafter, the lead 30 is introduced, and the infiltrated matrix is caused to shrink around the lead.

FIGS. 7 and 7a illustrate another embodiment of the invention similar to that of FIG. 6 but employing a modified form of graded seal. In making the FIG. 7 embodiment the lead 30 (while separate from assembly 39) is coated with a mixture of vitreous and metallic materials applied to the lead in multiple layers, as by dipping, brushing, or drawing through a bath. The layer nearest the lead has the highest concentration of metal and, progressing in a radial outward direction, the layers have progressively lower concentrations of metal. This combination of layers is represented by the sleeve-like component shown at 54 in FIG. 7. FIG. 7*a* is a cross-sectional view through the sleeve-like component 54 showing the layers at 55, 56, and 57.

In one form of the invention, the coated lead structure 30 is incorporated in the subassembly 39 of FIG. 7 by placing the lead structure in a mold containing a cavity having the shape of body 38 and with the lead structure extending along the central longitudinal axis of the mold cavity. Then the space in the mold cavity around the lead structure is filled with particles of vitreous material, which are then compacted, using a suitable press, to form a compact having the shape of body 38. Thereafter, the compact is removed from the mold and sintered in a furnace containing an inert atmosphere to convert the compact into the finished, hard body 38. Sintering and subsequent cooling of the vitreous body causes it to shrink about the coated lead structure 30 and to form a good hermetic seal therewith.

An alternative way of incorporating the lead structure 30 in the subassembly 39 is to compact the vitreous particles in the above-described mold but without the lead structure being present. Instead, there is an appropriately shaped core attached to one of the press members, or dies, used for compacting the particles; and this core provides a central passage in the compact approximately corresponding in shape and size to the coated lead 30. After the compacting operation, the coated lead 30 is inserted into this central passage, and the above-described sintering operation is effected. The sintering operation and subsequent cooling causes the vitreous body 38 to shrink about the coated lead 30 and to form a good hermetic seal therewith.

The sleeve 54 of FIG. 7 can alternatively be formed by providing about the lead 30 a porous sleeve of metallic foam material, e.g., tungsten or molybdenum, and then infiltrating this metallic foam material with vitreous material in powder form or in liquid form. Thereafter, the infiltrated sleeve is sintered. Thereafter, the lead 30 with the sleeve thereon is incorporated into the subassembly 39 in substantially the same manner as described herein above for incorporating the lead 30 with the multi-layer sleeve thereon.

FIG. 8 illustrates still another embodiment of the invention, which is similar to that of FIG. 6 except in the way that the lead structure 30 is constructed. This lead structure of FIG. 8 comprises inner and outer rods 32 and 34, preferably of tungsten or molybdenum, or their alloys, positioned in generally aligned relationship on the center line 27 of body 38. The adjacent ends of these rods 22 and 34 are spaced apart, but the rods are electrically interconnected by a conductor deposited in continuous paths extending through the body 38.

The subassembly of FIG. 8 is inserted into one leg of a quartz or glass envelope in the same manner as the subassembly 39 of FIGS. 1 and 2, following which a hermetic seal is made about the outer periphery of body 38 in substantially the same manner as described in connection with FIGS. 1 and 2.

The embodiment of FIG. 9 is similar to that of FIG. 8 except that the outer part 34 of lead structure 30 comprises a receptacle for a power connection, rather than a rod, as in FIG. 8. In addition, in FIG. 9 there is an annular base flange 60 at the outer end of the body 38. This flange is integral with the body 38 and is also formed of sintered vitreous particles. This flange can be used for mounting the arc tube in a precisely positioned manner. Preferably, the flange 60 is formed as an integral part of the body 38 during the same compacting and sintering operations used for forming the body 38. In the embodiment of FIG. 9, as in that of FIG. 8, the body 38 is a metallic ceramic through which electric current is conducted between the axially-spaced inner and outer portions 34 and 32 of the lead structure 30 when the lamp is in operation. The FIG. 9 subassembly fits into, and is sealed within, an opening in the lamp envelope in the same manner as described in connection with FIGS. 1 and 2 for the subassembly 39.

Another process that can be used for forming the body 38 of FIGS. 6–9 is one employing sol-gel techniques. In accordance with such techniques, tetra-ethyl orthosilicate (TEOS) is admixed with alcohol and water, and the pH of this mixture is adjusted, either acid or basic, to catalyze the reaction between the components. The mix is then poured into the cavity of a mold conforming in shape and size to that desired for the body 38, where the reactants gel into a form having the shape and size of the mold cavity. The gel is then dried, slowly to avoid cracking. The dried gel is then heat treated at 600° to 900° C. to produce a porous but rigid body. Thereafter, a soluble metallic salt is adsorbed into the porous body by liquid doping, then reduced to the metallic form. Thereafter, the resulting structure is sintered at about 1000° to 1100° C. in an inert atmosphere, producing a dense gel glass. This latter material is a conductive glass with a low coefficient of thermal expansion suitable for the lamp seal structure of FIGS. 6–9.

Other glass compositions can be made by the process of the immediately-preceding paragraph by adding salts or organometallics to the TEOS mixture and co-gelling these components together.

A second sol gel approach involves starting with a fibrous or reticulate metallic structure of molybdenum or tungsten or the like, which structure provides an electrical conducting network. This metallic structure is placed within the mold cavity and the TEOS mixture is poured into the cavity, causing it to infiltrate and surround the metallic structure. The components of the TEOS mixture then react to form a gel filling the mold cavity. The gel is then slowly dried, heat treated to produce a rigid body, and is then sintered into a dense glass that includes the conducting network of metal.

While the above-described processes employing sintering are preferred processes for manufacturing the body 38 of FIGS. 6–9, another process that can be used for such manufacture is the following. Vitreous material is heated to a high temperature that reduces it to a molten liquid state, and into this molten liquid, molten metal is introduced. Sufficient agitation of this mixture is provided to obtain the desired distribution of metal within the vitreous material. This molten mixture is poured into a suitably-shaped mold in which the lead structure 30 is present, and upon cooling a body having the shape and size of body 38 is formed.

While FIGS. 1–9 illustrate our invention as applied to discharge-type lamps, it is to be understood that the invention also has application to certain filament-type lamps. One such filament-type lamp is the double-ended halogen lamp referred to hereinabove under "BACKGROUND". In this lamp the chamber surrounding the filament of the lamp has a surface coated with filtering material that transmits visible light radiation but reflects back to the filament infrared radiation. Precise radial alignment of the filament along the optical axis of the filament chamber is required in order to assure that the reflected infrared radiation strikes the filament and converts the reflected infrared to visible light.

FIG. 10 shows how a subassembly 39 similar to that of FIG. 2 can be constructed to adapt it for use in a filament lamp of the above type. FIG. 10 employs reference numerals identical to those used in FIG. 2 to designate corresponding parts. This subassembly 39 of FIG. 10 is essentially the same as that of FIG. 2 except that the inner portion of the lead structure instead of being a straight rod (32) carrying an electrode tip (24) is an L-shaped spud 32 including a transversely-extending end portion 101. One end of the lamp filament is welded to this transversely-extending portion 101 in the same manner as described in the aforesaid U.S. Pat. No. 4,942,331—Bergman et. al. The body 38 of FIG. 10 is of a sintered vitreous material formed about the lead structure 32,33, 34 in the same manner as the body 38 of FIG. 2 is formed about its associated lead structure.

FIG. 11 shows two subassemblies such as 39 of FIG. 10 welded to opposite ends of a tungsten filament 104 to form a filament assembly 106. Once the welds have been made and the filament assembly completed, the filament assembly is drawn into a double-ended lamp envelope having generally the configuration of the envelope 12 of FIG. 1. Any suitable means can be used for drawing the filament assembly into the envelope. When the drawing operation has been completed, the bodies 38 are located within the legs 16 and 18 of the envelope and the filament is located on the central, or optical, axis of the bulbous portion 14 of the envelope, as shown in FIG. 12. Thereafter suitable hermetic seals are made between the legs 16 and 18 of the envelope and the bodies 38, and the interior of the envelope is filled with a suitable gaseous filler, preferably a halogen-containing filler. The seals are made and the filling operation performed in essentially the same manner as described in connection with the embodiment of FIGS. 1 and 2.

The bulbous portion 14 of the envelope, referred to hereinabove as the filament chamber, is externally coated with filtering material that transmits visible light radiation emanating from the filament but reflects infrared radiation back to the filament 104, as above explained. The sintered bodies 38, in cooperation with the legs 16 and 18, are very effective in holding the filament 104 in its desired position on the optical axis 27 of the lamp where it is best located to be stricken by the reflected infrared radiation.

The embodiment of FIGS. 3–5 can be modified to adapt it for use as a filament-type lamp basically by substituting the filament assembly of FIG. 11 for the two lead-in structures 32, 33, 34, and the electrode tips 24, 26 of FIG. 3–5.

Each of the subassemblies of FIGS. 6, 7, 8, and 9 can be modified to adapt it for use in a filament-type lamp by substituting for its inner rod 32 and electrode tip 24 the L-shaped spud 32 of FIG. 10. In the finished lamp, there are two of these subassemblies mounted within an envelope, as shown in FIG. 12, and with a filament attached at its opposite ends to the end portions 101 of the spuds 32, as is also shown in FIG. 12.

In each of the modified embodiments of the immediately-preceding two paragraphs each body 38 is of a sintered vitreous material provided about the lead-in structure in the same manner as described in connection with the corresponding embodiment of FIGS. 6, 7, 8, and 9. Similarly, the body 38 in each of these modified embodiments is of the same composition as described in connection with the corresponding embodiment of FIGS. 6, 7, 8, and 9.

While our invention is especially applicable to double-ended lamps and has been illustrated in FIGS. 1–12 as being so applied, the invention in its broader aspects also has application to single-ended lamps. FIGS. 13 and 14 show such single-ended lamps, depicting them at an intermediate stage of their assembly. Referring finest to FIG. 13, there is shown a single-ended envelope 12 of vitreous light-transmitting material comprising a bulbous portion 114 and a cylindrical leg portion 116 at one end of the bulbous portion. Within the bulbous portion 14 is light-generating means in the form of a filament 120 having terminals 122 and 124 at its respective opposite ends. Current is supplied to the filament through a pair of lead members 130 and 134 which are respectively joined at their upper ends to the terminals 122 and 124 of the filament.

The lead members 130 and 134 are supported by a body 138 of vitreous material that is produced in essentially the same manner as the body 38 of FIG. 7. But before the body 138 is formed, each lead member is coated with a mixture of vitreous and metallic materials applied to the lead members in multiple layers, as by dipping, brushing, or drawing through a bath. This coating is substantially the same as the sleeve-like component 54 described in connection with FIG. 7 and is designated 54 in FIG. 13. The coated lead members, laterally spaced as shown in FIG. 13, are then placed in a mold cavity and particles of vitreous material are added to the mold cavity to fill the space around the lead members. Then, using a suitable press, the particles are pressed into a compact having the size and shape of body 138. This compact with the imbedded lead members is then removed from the mold and sintered in a furnace containing an inert atmosphere to convert the compact into the finished hard body 138. Sintering and subsequent cooling of the vitreous body causes it to shrink about the coated lead members and to form a good hermetic seal therewith.

After the body 138 has been produced as above described, the filament 120 is connected between the spaced-apart ends of the lead members 130 and 134 t,D form a subassembly comprising body 138, leads 130 and 134, and filament 120. This subassembly is then inserted into the tubular leg 116 of the envelope, following which a hermetic seal is made between the leg 116 and the body 138 in substantially the same manner as described hereinabove in connection with the seal between parts 16 and 38 in the other embodiments. The envelope 112 is evacuated and then filled in the same manner as described hereinabove, i.e., either through a tubularion (not shown) or through a space (not shown) present around body 138 before the sealing operation.

The single-ended lamp of FIG. 14 is produced in basically the same manner as the lamp of FIG. 13. The lamp of FIG. 14 is a discharge lamp comprising electrode tips 140 and 142 between which an arc is developed during lamp operation to generate light within the bulbous portion 114 of the lamp. This lamp comprises lead members 130 and 134 extending through a body 138 of vitreous material that is formed and is sealed to the lead members in the same manner as described in connection with the FIG. 13 embodiment. The leg 116 of the envelope 112 is hermetically sealed to the body 138 in the same manner as described in connection with FIG. 13.

While we have illustrated graded-type seals being used around the lead members in the embodiments of FIGS. 13 and 14, it is to be understood that foil-type seals corresponding to the foil-type seals of FIGS. 1–5 could instead be used in the embodiments of FIGS. 13 and 14 in place of the graded seals. It is also to be understood that a sealing arrangement corresponding to that used in the embodiment of FIG. 8 could be used in the embodiments of FIGS. 13 and 14. FIG. 17 shows one way in which this can be accomplished. Each of the leads 130 and 134 is made in two axially-spaced sections and the localized regions 160 and 162 of the vitreous body 138 between and around each pair of these sections is infiltrated, or doped, with conductive metal that serves to conduct current between the sections.

In the embodiments of FIGS. 13 and 14, the vitreous body 138 serves to position the lead members in a precise predetermined manner and also to provide precise control of the inner geometry of the chamber 150 in which light is generated. In this latter respect, the upper surface 152 of the body 138 has a predetermined shape and location that are substantially unaffected by the sealing operation between parts 116 and 138.

FIG. 15 illustrates an embodiment of the invention similar to that of FIG. 3 except that the vitreous body 38 of FIG. 15 is of a somewhat different shape than the body 38 of FIG. 3. Only the lower end of the lamp is shown in FIG. 15. In FIG. 15 the body 38 may be thought of as a female part that contains an annular groove 41 for receiving the lower end of tubular envelope 12. The subassembly 39 of FIG. 15 is otherwise essentially the same as the left-hand subassembly 39 of FIG. 3 and comprises similar parts correspondingly designated. In both embodiments, body 38 is made of vitreous particles compacted round the lead structure 32, 33, and 34 and then sintered in a furnace to produce a hard body. The lower end of the tubular envelope 12 (FIG. 15) is then inserted into the groove 41, and a hermetic seal is made between the body 38 and the end of envelope 12 by heating the outer flange 44 of the body to a softened state and then collapsing this flange about the end of the tubular envelope.

One noteworthy feature of the FIG. 15 embodiment is that the body 38 precisely positions the electrode tip 24 in a direction along the longitudinal axis 27 of the envelope 12 as well as radially of the envelope. In this respect, the base of groove 41 forms a shoulder 45 that abuts against one end of the tubular envelope when the parts are assembled into their positions of FIG. 15.

As in the FIG. 3 embodiment, the inner surface 40 of the lower body 38 (FIG. 15) is of a concave shape that smoothly merges into the bore of the cylindrical envelope 12. The shape and position of this surface 40 is substantially unaffected by the above-described sealing operation that produces a hermetic seal between flange 44 and body 38.

The upper end of the FIG. 15 lamp (not shown) is essentially a mirror image of the illustrated lower end. In this upper end, a vitreous body 38 identical to the lower body 38 has a groove 41 that receives the upper end of the envelope. A hermetic seal is present between the upper end of the envelope and upper body 38.

FIG. 16 illustrates still another embodiment of the invention, this embodiment being similar to that of FIG. 15 except that the vitreous body 38 of FIG. 16 is of a somewhat different shape than the body 38 of FIG. 15. Corresponding parts of the embodiments of FIGS. 15 and 16 are designated with corresponding reference numerals. In the FIG. 16 embodiment the body 38 does not extend into the opening, or bore, of the tubular envelope 12 but merely closes off this bore.

The flange portion 41 of body 38 surrounds the lower end of the envelope 12 and in the finished lamp is hermetically sealed to this lower end. A shoulder 45 on the body 38 abuts against the lower end surface of the tubular envelope to establish the axial position of the body 38 and the electrode tip 24 with respect to the envelope 12. The flange portion 41, by closely surrounding the lower end of envelope 12, establishes the radial position of the electrode tip 24 with respect to the envelope 12.

An advantage of the FIG. 16 embodiment over that of FIG. 15 is that the body 38 is relatively simple in shape and thus is more easily formed. The bodies 38 of both embodiments are formed of vitreous particles consolidated about the lead structure 32, 33, 34 and sintered together.

While we have shown and described particular embodiments or our invention, it will be obvious to those skilled in the art that various changes and modifications may be made without departing from the invention in its broader aspects; and we, therefore, intend herein to cover all such changes and modifications as fall within the true spirit and scope of our invention.

What is claimed is:

1. A lamp comprising:

(a) an envelope of vitreous light-transmitting material enclosing an internal space, (b) light-generating means within said internal space for generating light when electric current is passed therethrough, (c) conductive lead structure projecting into said internal space for supplying electric current to said light-generating means, (d) a body of vitreous material surrounding and sealed to said lead structure and formed of particles of vitreous material pressed together and sintered said body extending through an opening in said envelope that communicates with said internal space, and (e) a seal between said envelope and said body in the interface region between said envelope and said body.

2. The lamp of claim 1 in which said body of vitreous material has an inner end facing said internal space, said inner end having a concave configuration.

3. The lamp of claim 2 in which a metal having generally the same coefficient of thermal expansion as the metal of said conductive lead structure is incorporated in said body of vitreous material and is distributed within said body in such a manner that the concentration of said metal is higher in the region of said conductive lead than in said interface region.

4. The lamp of claim 1 in which a conductive species is incorporated within said body of vitreous material in the region of said body bordering said conductive lead structure.

5. The lamp of claim 1 in which the seal between said lead structure and said body of vitreous material includes a sleeve disposed between said lead structure and said body, the material of said sleeve being a combination of vitreous material and metal.

6. The lamp of claim 1 in which the seal between said lead structure and said body of vitreous material includes a sleeve disposed between said lead structure and said body, said sleeve comprising a plurality of layers, the material of one or more layers being a combination of vitreous material and metal, the concentration of metal being higher in the layer adjacent said lead structure than in the layer adjacent said body of vitreous material.

7. The lamp of claim 1 in which the seal between said lead structure and said body of vitreous material includes a sleeve disposed between said lead structure and said body, said sleeve being constructed of porous metal structure infiltrated with vitreous material.

8. A lamp as defined in claim 1 and in which:

(a) said light-generating means comprises a pair of spaced-apart electrode tips between which an electric arc is established to generate light, and (b) means is provided for supporting one of said electrode tips on said conductive lead structure.

9. A lamp as defined in claim 1 and in which:

(a) said light-generating means comprises a filament that is energized by current through said conductive lead structure to generate light, said filament having two ends, and (b) means is provided for connecting one of said filament ends to the inner end of said conductive lead structure.

10. A lamp as defined in claim 1 and in which:

(a) said light-generating means comprises a pair of spaced-apart terminals between which current flows during light generation, (b) said conductive lead structure comprises a pair of lead members respectively connected to said terminals, and (c) said body of vitreous material surrounds both of said lead members and is sealed to both of said lead members.

11. A lamp as defined in claim 1 and in which:

(a) said envelope has a tubular portion surrounding said opening, and (b) said body of vitreous material has a shoulder that

12. A lamp as defined in claim 1 and in which:

(a) said envelope has a tubular portion surrounding said opening, and (b) said body of vitreous material contains a groove that receives one end of said tubular portion.

13. A lamp comprising:

(a) a tubular envelope of vitreous light-transmitting material enclosing an internal space where light is generated, (b) light-generating means within said internal space for generating light when electric current is passed therethrough, (c) a body of vitreous material formed of particles of vitreous material pressed together and sintered, said body extending through an opening in said envelope that communicates with said internal space, (d) conductive terminal structure near the outer end of said body of vitreous material, (e) a seal between said envelope and said body in the interface region between said envelope and said body, and in which:

(f) said body of vitreous material includes conductive metal distributed within said body of vitreous material and serving to conduct electric current through said body between said light-generating means and said terminal structure during lamp operation.

14. The lamp of claim 13 in which said conductive metal is a refractory metal.

15. A lamp comprising:

(a) an envelope of vitreous light-transmitting material enclosing an internal space, (b) light-generating means within said internal space for generating light when electric current is passed therethrough, (c) conductive lead structure projecting into said internal space for supplying electric current to said light-generating means, (d) a body of vitreous material surrounding and sealed to said lead structure and formed of particles of vitreous material sintered together, said body covering an opening in said envelope that communicates with said internal space, and (e) a seal between said envelope and said body in the interface region between said envelope and said body.

16. The lamp of claim 15 in which said body of vitreous material has an inner end facing said internal space, said inner end having a concave configuration.

17. The lamp of claim 15 in which a conductive species is incorporated within said body of vitreous material in the region of said body bordering said conductive lead structure.

18. A lamp as defined in claim 15 and in which:

(a) said envelope has a tubular portion surrounding said opening and said body of vitreous material has a flange surrounding said tubular portion, and (b) the seal is located between said flange and said tubular envelope portion.

* * * * *